US005155539A

United States Patent [19]

Yamaguchi et al.

[11] Patent Number: 5,155,539

[45] Date of Patent: Oct. 13, 1992

[54] SHEET SEPARATING MECHANISM

[75] Inventors: Hiroyuki Yamaguchi, Tokyo; Yoshio Monma, Saitama, both of Japan

[73] Assignee: Asahi Kogaku Kogyo Kabushiki Kaisha, Tokyo, Japan

[21] Appl. No.: 711,953

[22] Filed: Jun. 7, 1991

[30] Foreign Application Priority Data

Jun. 7, 1990 [JP] Japan ..... 2-149367

[51] Int. Cl.[5] ..... G03G 15/00; G03G 15/16

[52] U.S. Cl. ..... 355/315; 355/274

[58] Field of Search ..... 355/271, 274, 311, 315, 355/309; 271/900

[56] References Cited

U.S. PATENT DOCUMENTS

| | | | |
|---|---|---|---|
| 4,377,333 | 3/1983 | Tsuji et al. | 355/309 |
| 4,392,738 | 7/1983 | Fujino et al. | 355/271 |
| 4,929,982 | 5/1990 | Ainoya et al. | 355/311 |
| 5,023,667 | 6/1991 | Negoro et al. | 355/274 |

*Primary Examiner*—Joan H. Pendegrass

*Attorney, Agent, or Firm*—Sandler, Greenblum & Bernstein

[57] ABSTRACT

In a sheet separating mechanism, adapted to be positioned in an imaging device, for forming an image through an electrophotographic system, using a fan-folded sheet on which a visible image having been formed on a predetermined photoconductive member is to be transferred by means of a charger member arranged to be retractable from an operating position at which the transferring operation is to be executed onto the fan-folded sheet being fed in a predetermined direction, for separating the fan-folded sheet from the predetermined photoconductive member when the charger member is retracted from the operating position; the sheet separating mechanism comprising a pressing member arranged to be contacted with an image-forming surface of the fan-folded sheet for pressing the fan-folded sheet. Thus, the fan-folded sheet is forced to be separated from the predetermined photoconductive member when the charger member is retracted from the operating position.

12 Claims, 6 Drawing Sheets

SHEET SEPARATING MECHANISM

BACKGROUND OF THE INVENTION

The present invention relates to a sheet separating mechanism, adapted to be positioned in an imaging device, such as a printer utilizing a so-called electrophotographic system, for separating a recording sheet from a photoconductive member on which a toner image has been formed. More particularly, the present invention relates to a sheet separating mechanism capable of definitely separating the recording sheet from the photoconductive member when a transfer charger for executing a transfer operation onto the recording sheet is retracted from an operating position thereof.

Conventionally, there has been known an imaging device utilizing an electrophotographic system in which a latent image is formed on a photoconductive member, such as a drum having been evenly charged with a predetermined polarity in advance, toner particles are adhered on a surface of the photoconductive member in accordance with the latent image, i.e., a visible toner image corresponding to the latent image is formed on the photoconductive member, and the toner image is transferred and fixed onto a predetermined recording medium such as a continuous-form recording sheet.

As the imaging device, there is an electrophotographic printer for printing information on a folding type continuous sheet with feed holes, which is called a fan-folded sheet similar to that used in a conventional line printer and the like.

The fan-folded sheet is arranged in such a manner that a boundary between two pages thereof is provided with a perforated tear line along which the sheet is to be cut. Thus, the fan-folded sheet is alternately folded along the perforated tear line in the opposite direction and applied to the imaging device in a stacked state.

Incidentally, a printer using the fan-folded sheet as a recording medium must begin a printing operation for each of the pages at a position separated apart from the perforated tear line by a predetermined distance. That is, the printing operation is started at the position separated apart from a leading edge in a direction along which the printing operations are executed. In the above arrangement of the electrophotographic system, each of operation units utilized therein, i.e., a charging unit, an exposure unit, development unit, and transfer unit, are provided around the photoconductive drum, and each of the units are sequentially put into operation as the photoconductive drum is rotated. Thus, a visible image is transferred onto the recording medium, i.e., fan-folded sheet, when the developed portion of the photoconductive drum at which the visible image is formed gets to a transfer position during the rotation of the photoconductive drum. Therefore, a print start point on the fan-folded sheet must be adjusted by relatively moving, i.e., rotating, the photoconductive drum with respect to the fan-folded sheet. In other words, before the printing operation is executed, it is necessary to control a positional relationship between an image forming start point on the photoconductive drum and the fan-folded sheet in such a manner that the position of the photoconductive drum at which exposure is to be started is coincided with the print start point of each of the pages of the fan-folded sheet.

If the fan-folded sheet is kept in contact with the photoconductive drum, i.e., the sheet is kept in a transfer state, a problem arises in that, during the above-described position adjusting operation, the photoconductive material adhered on the photoconductive drum is scratched or worn to shorten the life of the photoconductive drum, while the fan-folded sheet is stained with toner while remaining on the surface of the photoconductive drum. To cope with this problem, there have been prior art systems, for retracting the transfer charger from the operating position thereof at which the transfer charger causes the fan-folded sheet to be contacted with the photoconductive drum, for example, as disclosed in, Japanese Patent Provisional Publication HEI 2-103076. In such conventional charger retracting systems, the transfer charger is arranged to be synchronously retracted from the operating position thereof with cease of a feeding operation of the fan-folded sheet and, further returned to the operating position when the exposure start position reaches a transfer position during the rotation of the photoconductive drum.

Nevertheless, a problem arises in that the fan-folded sheet is not definitely separated from the photoconductive drum even if the transfer charger is retracted from the operating position after completion of the printing operation. In other words, since the fan-folded sheet is arranged to be separated from the photoconductive drum only by its own weight, it is often kept in contact with the photoconductive drum even if the transfer charger is retracted. As a result, the fan-folded sheet is stained by the toner when a printing operation is resumed. This problem is more often caused when the folding direction of the perforated tear line on the fan-folded sheet is directed toward the photoconductive drum side. In a low-humidity condition, for example, in winter, the fan-folded sheet and the photoconductive drum are apt to be contacted with each other by so-called electrostatic force therebetween, and the above-described problem is more often caused.

SUMMARY OF THE INVENTION

It is therefore an object of the present invention to provide an improved sheet separating mechanism capable of definitely separating the fan-folded sheet from the photoconductive drum when the transfer charger is retracted from the operating position thereof.

For this purpose, according to the present invention, there is provided a sheet separating mechanism, adapted to be positioned in an imaging device, for forming an image through an electrophotographic system, using a fan-folded sheet on which a visible image having been formed on a predetermined photoconductive member is to be transferred by means of a charger member arranged to be retractable from an operating position at which the transferring operation is to be executed onto the fan-folded sheet being fed in a predetermined direction, for separating the fan-folded sheet from the predetermined photoconductive member when the charger member is retracted from the operating position.

The sheet separating mechanism includes a pressing member that is arranged to be in contact with an image-forming surface of the fan-folded sheet for pressing the fan-folded sheet, whereby the fan-folded sheet is forced to be separated from the predetermined photoconductive member when the charger member is retracted from the operating position.

DESCRIPTION OF THE ACCOMPANYING DRAWINGS

DESCRIPTION OF THE EMBODIMENTS

Figure 1:
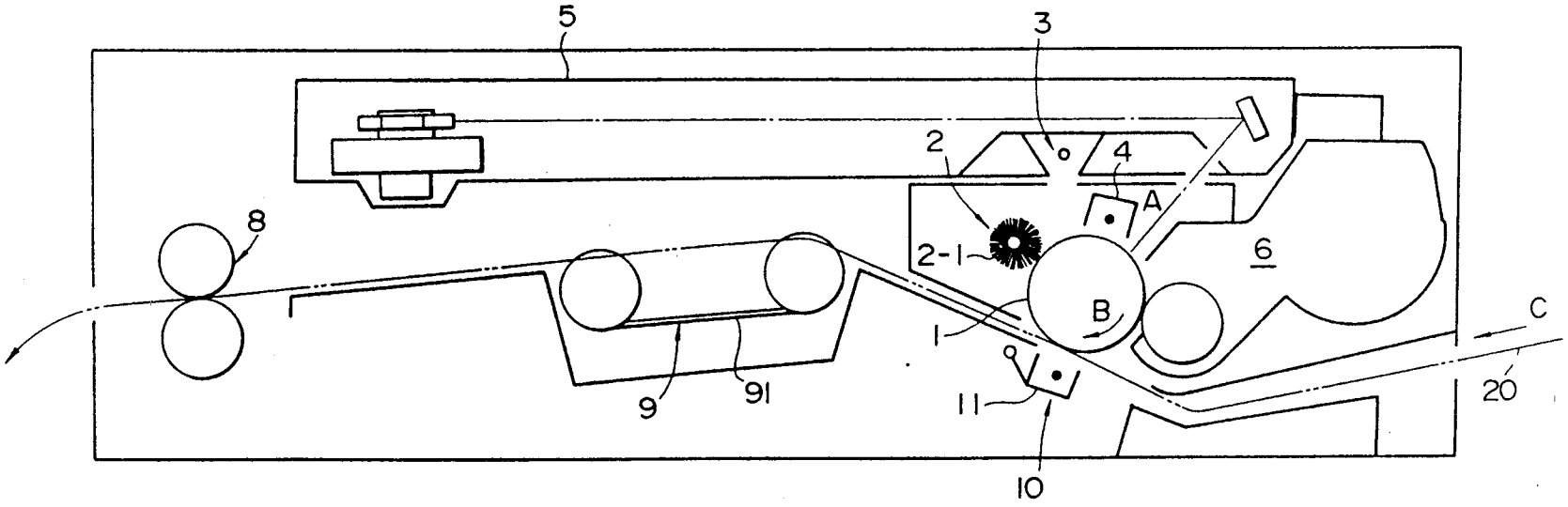
FIG. 1 is a side view showing a schematic arrangement of a printer provided with an embodiment of a sheet separating mechanism according to the present invention, in which a fan-folded sheet is utilized.

With referring to the drawings, embodiments of the present invention will be described hereinafter.

FIG. 1 shows a laser beam printing device, using a continuous-form fan-folded sheet 20 as a recording medium, by which character and/or information inputted from an external computer and the like are printed on the fan-folded sheet by a so-called electrophotographic system.

A charging unit 4 at which a surface of a photoconductive drum 1 is evenly charged, a scanning optical system 5 by which a laser beam having been modulated by image information is directed, as indicated by an arrow "A" onto the surface of the photoconductive drum 1 for forming a latent image, a development unit 6 at which the latent image is made visible by adhering toner, transfer unit 10 at which the visible image is transferred onto the fan-folded sheet 20, i.e., a recording medium, a cleaning unit 2 including a brush member 2-1 arranged to be contacted with the photoconductive drum 1 for cleaning toner particles remained thereon after the transfer operation, and a discharging unit 3 for discharging the photoconductive drum 1 are provided around a rotating direction of the photoconductive drum, as indicated by an arrow "B". Each of the above-mentioned units are, and each of the units put into operation as the photoconductive drum is rotated.

Further, a fixing unit 8 at which the transferred toner image is fixed onto the fan-folded sheet disposed at a downstream side of the photoconductive drum 1, and a tractor 9 including a tractor belt 91 through which the fan-folded sheet 20 is fed toward the fixing unit 8 is provided as shown in FIG. 1.

As the photoconductive drum 1 is rotated in the "B" direction, the surface of the photoconductive drum 1 is evenly charged with a predetermined polarity, and is then scanned by light from the scanning optical system 5 having been ON/OFF modulated in accordance with the image information to be printed. As a result, the exposed part is discharged by light and a latent image is formed on the photoconductive drum 1 as a distribution of the discharged portion.

Figure 2:
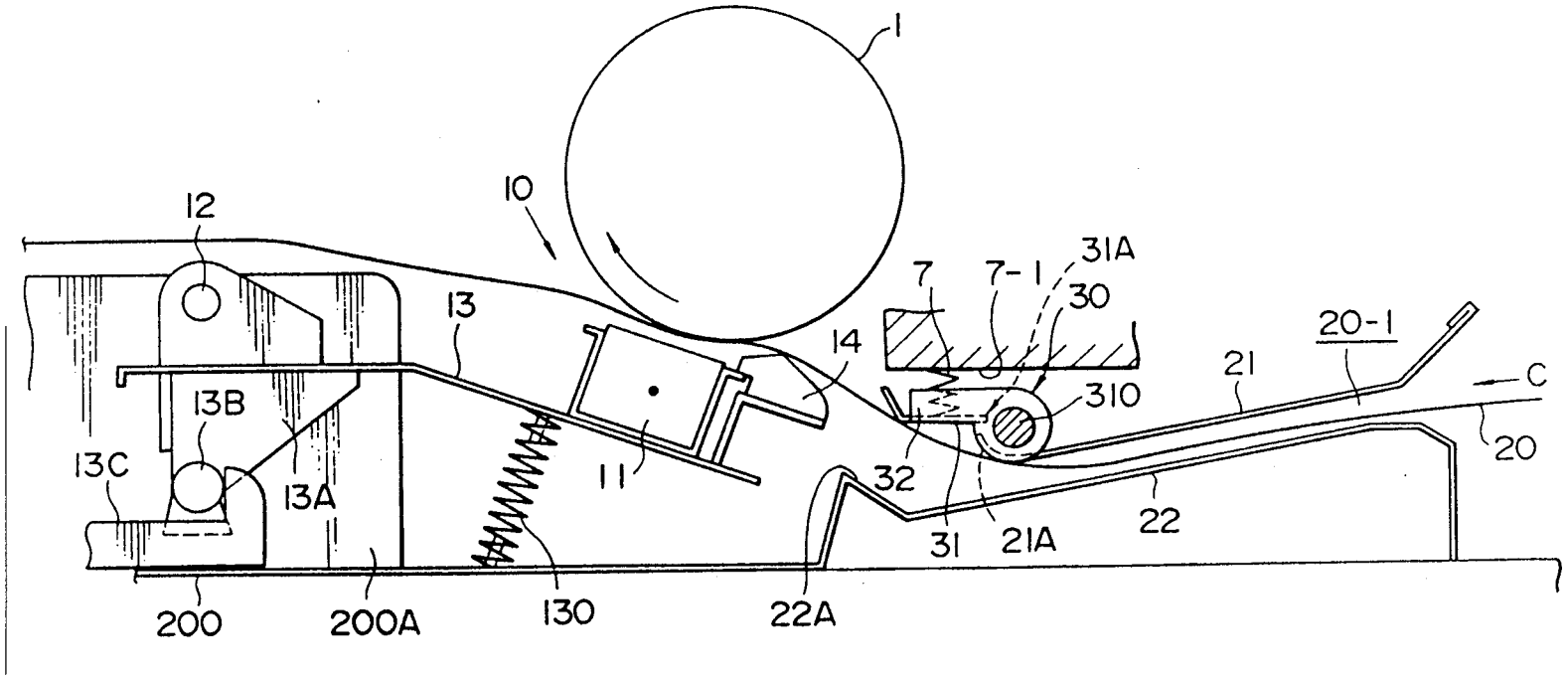
FIG. 2 is a partial enlarged view of a transfer unit of a printer shown in FIG. 1, in which one embodiment of a sheet separating mechanism according to the present invention is employed.
Figure 3:
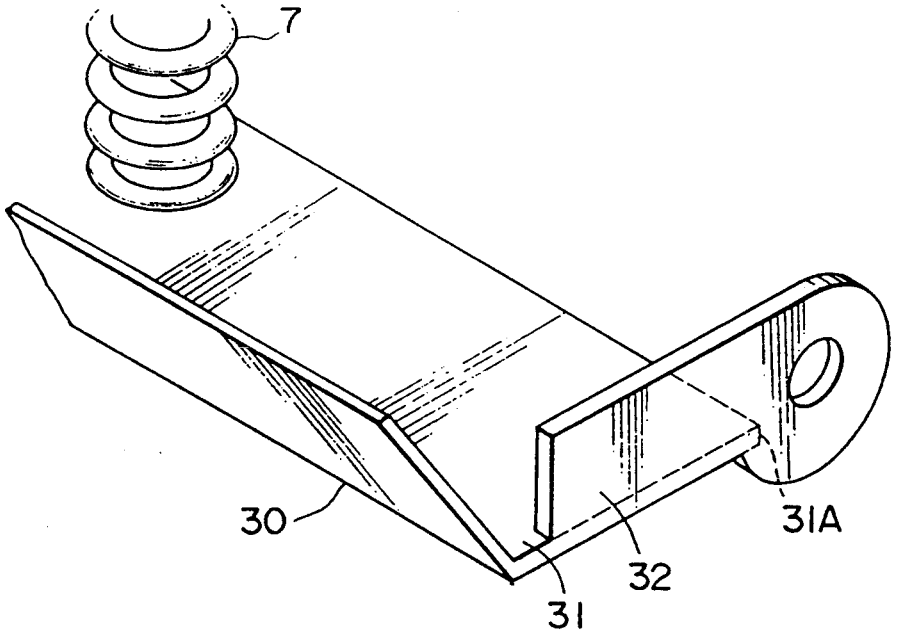
FIG. 3 is a partial perspective view of a press arm member mounting a spring member, which is employed in a sheet separating mechanism shown in FIG. 2.

The latent image is made visible by adhering toner particles at the development unit 6, and the toner image is transferred onto the fan-folded sheet 20 at the transfer unit 10. The transfer unit 10 comprises a corona charger 11 extending across the width of the fan-folded sheet 20 and provided in parallel with the photoconductive drum 1. At both side edges along a longitudinal direction of the photoconductive drum 1, a pair of brackets 200A (only one of the brackets is illustrated in the drawing of FIG. 2) is erected from a chassis 200 of the printer and a supporting arm member 13 is pivotally supported by a shaft 12 provided between the brackets 200A. The corona charger 11 is mounted on the supporting arm 13.

As indicated by an arrow "C", the fan-folded sheet 20 is inserted at the right side of the drawing and fed toward the left side. The fan-folded sheet 20 is fed through a transfer position at which the photoconductive drum 1 and the corona charger 11 are opposed to each other, and the fan-folded sheet 20 is charged by the corona charger 11. Thereafter, the toner image, composed of a multiplicity of toner particles, is transferred onto the fan-folded sheet 20.

Between an under surface of the supporting arm 13 and the chassis 200, a spring 130 is provided for supplying biasing force to the supporting arm 13, i.e., the supporting arm 13 is arranged to be rocked around the shaft 12 and the corona charger 11 is positioned opposed to the photoconductive drum 1.

On an under surface of the supporting arm member 13, at the downstream side along a sheet feeding direction, a lever member 13A is provided and a pin 13B is provided thereon to be horizontally projected. The pin 13B is arranged to be contacted with a hook member 13C movable along the sheet feeding direction, i.e., the rightward and leftward directions in the drawing of FIG. 2, by means of a not shown driving source. When the hook member is moved leftward in the drawing, the arm member 13 is rocked clockwise against the biasing force generated by the spring 130 and the corona charger 11 is retracted, with a predetermined distance, from an operating position at which the transfer operation is executed.

On the supporting arm member 13 at the upstream side of the corona charger 11, a pressing member 14 having a semi-circular cross section, for upwardly pressing the fan-folded sheet 20 when the corona charger 11 is located at the operating position, is adjacently provided therewith. Accordingly, the fan-folded sheet 20 is upwardly pressed by the pressing member 14 and contacted to the photoconductive drum 1 with predetermined pressure force.

At the upstream side of the transfer unit 10, a sheet feeding path 20-1, comprising an upper sheet guide 21 and a lower sheet guide 22, is formed along which the fan-folded sheet 20 is fed into the transfer unit 10. As shown in FIG. 2, the sheet feeding path is arranged to be downwardly directed as the path is neared to the transfer unit 10.

Figure 4:
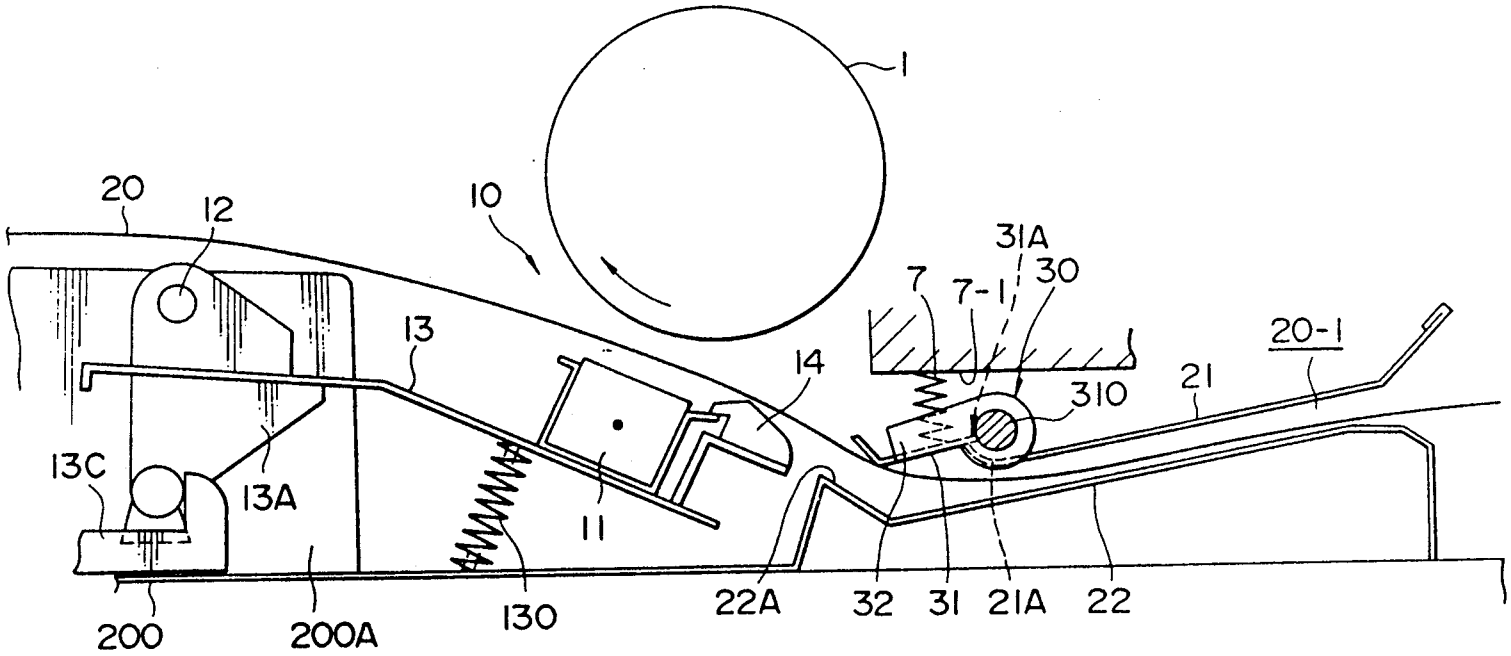
FIG. 4 is a partial enlarged view of a transfer unit of a printer shown in FIG. 1, wherein a transfer charger is retracted from an operating position thereof.

On an upper surface of the upper sheet guide 21, a press arm member 30, comprising a plate part 31 and a stopper part 31A, is mounted. The plate part 31 is arranged to be contacted with an image-forming surface of the fan-folded sheet 20. The press arm member 30 is provided with a pair of supporting parts 32 at the side edges thereof by upwardly bending both side edges of the plate part 31. The press arm member 30 is also supported by a shaft 310 provided in parallel to the photoconductive drum 1. In other words, the press arm member 30 is arranged to be rockable around the shaft 310 located at the upstream side of the transfer unit 10. Further, another spring 7 is mounted, for applying biasing force to the press arm member 30, between the plate part 31 and a predetermined member 7-1 such as a chassis located above the press arm member 30. In other words, the press arm member 30 is rocked counterclockwise around the shaft 310 by the biasing force generated by the spring 7. As shown in FIG. 4, when the corona charger 11 is retracted from the operating position thereof, the press arm member 30 is rocked around the shaft 310 and stopped by the contact between the stopper part 31A of the press arm member 30 and a contact part 21A formed on the upper sheet guide 21 at the extreme edge. In other words, the rocking operation of the press arm member 30 is regulated by the contact part 21A of the upper sheet guide 21.

At the extreme end of the lower sheet guide 22, sheet guide part 22A is formed from a bent portion upwardly directed towards the photoconductive drum 1. The lower sheet guide 22 is arranged, as shown in FIG. 4, so as to have a predetermined interval from the plate part 31 of the press arm member 30 having been rocked.

In this above-described arrangement, during a transfer state in which the corona charger is located at the operating position and a transfer operation is to be executed, the fan-folded sheet 20 having been fed along the sheet feeding path 20-1 surpasses the contact part 21A and is directed to the photoconductive drum 1 through the pressing member 14 as shown in FIG. 2. In this state, the press arm member 30 is biased counterclockwise by the spring 7, however, since tension force, generated by the pressing member 14, between the contact part 21A and the pressing member 14 is arranged to be larger than the biasing force generated by the spring 7, the fan-folded sheet 20 is fed from the contact part 21A to the pressing member 14 without being downwardly warped.

On the contrary, in a state in which the corona charger 11 is retracted from the operating position thereof, as shown in FIG. 4, the fan-folded sheet 20 is not upwardly pressed by the pressing member 14 and the tension force between the contact part 21A and the pressing member 14 is lost. Therefore, the fan-folded sheet 20 is downwardly warped by the press arm member 30 being rocked by the spring 7. In other words, the fan-folded sheet 20 is definitely separated from the photoconductive drum 1.

When the fan-folded sheet 20 is newly applied to the printer, that is, the fan-folded sheet 20 is not located within the sheet feeding path 20-1, the press arm member 30 is limited by the predetermined interval from the lower sheet guide 22, thus, the new fan-folded sheet 20 can be easily applied to the printer. That is, the fan-folded sheet 20 is passed through the sheet feeding path 20-1, and can be easily passed through the interval between the press arm member 30 and the lower sheet guide 22.

However, it is possible to delete the stopper part 31A, that is, the press arm member 30 can be arranged to be contacted with the lower sheet guide 22 when the press arm member 30 is rocked by the spring 7. Even if the press arm member 30 is contacted with the lower sheet guide 22 it is possible to feed the new fan-folded sheet 20 by raising the press arm member 30 against the biasing force generated by the spring 7. In this arrangement, since the rocking area of the press arm member 30 is made broader, the fan-folded sheet 20 can be more definitely separated from the photoconductive drum 1. Further, whether the interval between the press arm member 30 and the lower sheet guide 22 is to be provided or not, the length of the interval between the press arm member 30 and the lower sheet guide 22 can be determined in accordance with characteristics of the fan-folded sheet 20 to be fed and the elastic force of the spring 7 and the like.

Further, if a problem arises in that the fan-folded sheet 20 is broken by the press arm member 30 in cases where it is made by a material having high hardness such as metal, it is possible to avoid the problem by adhering an elastic plate arranged to be contacted with the fan-folded sheet 20 at the extreme edge of the press arm member 30. That is, in this case, the press arm member 30 is not contacted with the fan-folded sheet 20, but the elastic plate is contacted therewith and downwardly presses it in accordance with the rocking operation of the press arm member 30.

In the above described arrangements, the press arm member 30 is arranged to be rocked by the spring 7 and the fan-folded sheet 20 is downwardly pressed by the press arm member 30 when the corona charger 11 is retracted from the operating position. However, it may be considered that another type of arrangement is employed.

Figure 5:
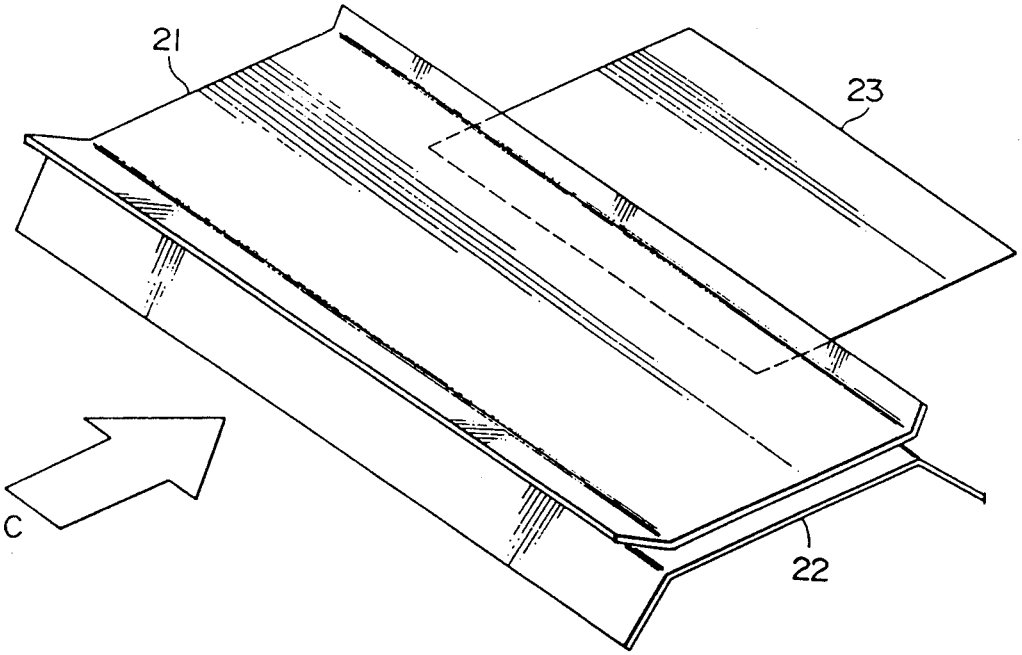
FIG. 5 is a partial perspective view of another embodiment of a sheet separating mechanism according to the present invention.

For example, as shown in FIG. 5, without using the press arm member, a plate member 23 made by an elastic material, such as PET (Polyethylene terephthalate, or in the Japanese usage, Polyethylene telephtalate) phosphor bronze and the like, is directly adhered to the upper sheet guide 21 by a predetermined manner, for example, double-sided adhesive tape, and located on the fan-folded sheet, not shown in the drawing.

When the fan-folded sheet is contacted with the press arm member 30 or the upper sheet guide 21, it is possible to definitely apply downward biasing force on the fan-folded sheet 20 even if accuracy of positioning between the press arm member 30 and the upper sheet guide 21 is not high. Further, it is possible to apply downward biasing force in an arbitrary area along the width of the fan-folded sheet 20.

Figure 6:
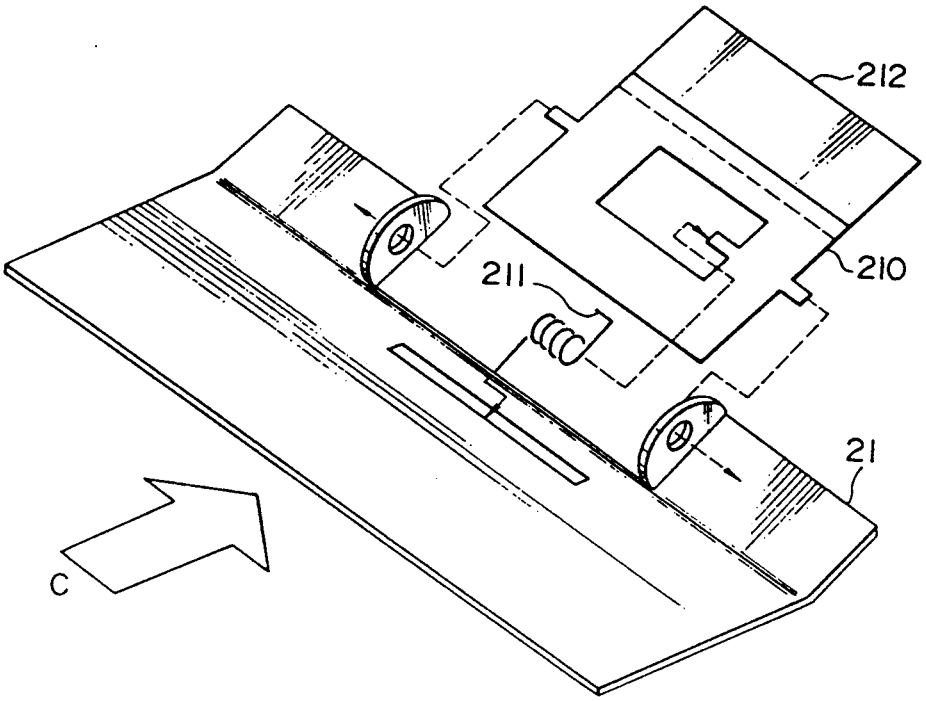
FIG. 6 is a partial perspective view of still another embodiment of a sheet separating mechanism according to the present invention.

Further, as shown in FIG. 6, it is possible to provide a plate member 210 to which an elastic plate member 212 is adhered on the upper sheet guide 21 through a torsion spring 211. In this arrangement, the plate member 210 is downwardly biased by means of the torsion spring 211 and the fan-folded sheet is separated from the photoconductive drum 1 when the corona charger 11 is retracted from the operating position.

Figure 7:
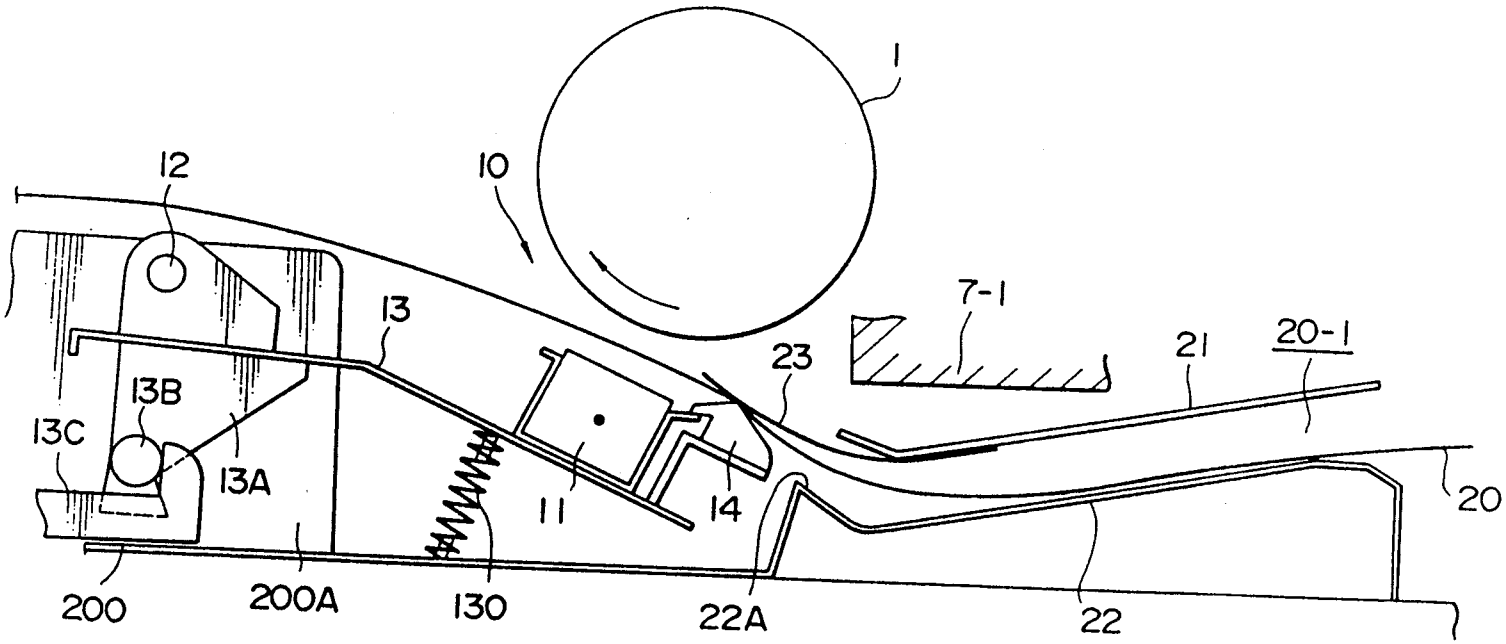
FIG. 7 is a side view of an improved embodiment of a sheet separating mechanism according to the present invention.

Further, it may be considered that, as shown in FIG. 7, an element to be contacted with the fan-folded sheet 20, the elastic plate member 23 in the drawing of FIG. 5, is extended to a position at which the fan-folded sheet 20 contacts the pressing member 14. In other words, the fan-folded sheet 20 is positioned between the pressing member 14 and the elastic plate member 23 near a transfer position, and accordingly, it becomes possible to separate the fan-folded sheet 20 from the photoconductive drum 1 more definitely. That is, by extending length of the element along the fan-folded sheet 20, i.e., by a simple improvement of the arrangement, a sheet separating operation can be made more definitely. The extension of the length of the elastic plate member to the position where the fan-folded sheet 20 contacts the pressing member 14, can also be applied to the embodiments of FIGS. 5 and 6.

As described above, by employing a sheet separating mechanism according to the present invention, it becomes possible to separate the fan-folded sheet on which a printing operation has been executed from the photoconductive drum. Therefore, it becomes possible to avoid problems, i.e., the photoconductive material on the drum being scratched or worn causing the life of the drum to be shortened, while the fan-folded sheet is stained with toner particles during contact with the surface of the drum, when the printing operation is resumed.

The present disclosure relates to subject matter contained in Japanese Patent Application No. HEI 2-149367 (filed on Jun. 7, 1990) and the Japanese Patent Application No. not-yet-assigned (filed on Apr. 5, 1991), which are expressly incorporated herein by reference in their entireties.

What is claimed is:

1. A sheet separating mechanism, adapted to be positioned in an imaging device, for forming an image through an electrophotographic system, using a fan-folded sheet on which a visible image formed on a photoconductive member is to be transferred by means of a charger member, arranged to be retractable from an operating position in which the transferring operation is to be executed onto the fan-folded sheet being fed in a predetermined direction, for separating said fan-folded sheet from said photoconductive member when said charger member is retracted from said operating position;

said sheet separating mechanism comprising a pressing member arranged to be contacted with an imaging forming surface of said fan-folded sheet for pressing said fan-folded sheet, said pressing member comprising an arm member, including a plate part that is in contact with said fan-folded sheet, arranged to be rocked by means of an elastic member, and a stopping mechanism for stopping said rocking arm member at a predetermined position, whereby said fan-folded sheet is forced to be separated from said predetermined photoconductive member when said charger member is retracted from said operating position.

2. The sheet separating mechanism according to claim 1, wherein said elastic member comprises a spring mounted on said plate part.

3. The sheet separating mechanism according to claim 1, wherein said stopping mechanism comprises a stopper part successively formed to said plate part and a contact part provided within said imaging device, said contact part being arranged to be contacted with said stopper part when said arm member is rocked by a predetermined amount.

4. A sheet separating mechanism, adapted to be positioned in an imaging device for forming an image through an electrophotographic system, using a fan-folded sheet on which a visible image formed on an photoconductive member is to be transferred by means of a charger member, arranged to be retractable from an operating position at which the transferring operation is to be executed onto the fan-folded sheet being fed in a predetermined direction, for separating said fan-folded sheet from said predetermined photoconductive member when said charger member is retracted from said operating position;

said sheet separating mechanism comprising a pressing member arranged to be contacted with an image forming surface of said fan-folded sheet for pressing said fan-folded sheet, whereby said fan-folded sheet is forced to be separated from said photoconductive member when said charger member is retracted from said operating position, said pressing member comprising an elastic sheet arranged to be contacted with said image forming surface of said fan-folded sheet.

5. The sheet separating mechanism according to claim 4, further comprising a second pressing member arranged to be integrally movable with said charger member for pressing said fan-folded sheet from the opposite surface of said image-forming surface when said charger is located at said operating position, and wherein said pressing member is located substantially at a position on said fan-folded sheet at which said second pressing member is contacted with said fan-folded sheet.

6. A sheet separating mechanism, adapted to be positioned in an imaging device, for forming an image through an electrophotographic system, using a fan-folded sheet on which a visible image formed on a photoconductive member is to be transferred by means of a charger member, arranged to be retractable from an operating position at which the transferring operation is to be executed onto the fan-folded sheet being fed in a predetermined direction, for separating said fan-folded sheet from said photoconductive member when said charger member is retracted from said operating position;

said sheet separating mechanism comprising a pressing member arranged to be contacted with an image-forming surface of said fan-folded sheet for pressing said fan-folded sheet, said pressing member comprising a plate member arranged to be rocked and an elastic sheet member adhered to said plate member, whereby said fan-folded sheet is forced to be separated from said photoconductive member when said charger member is retracted from said operating position.

7. A sheet separating mechanism, adapted to be positioned in an imaging device that includes a photoconductive member, a charger member, and a fan-folded sheet upon which an image is to be formed, comprising;

a first pressing member arranged to be contacted with an image-forming surface of said fan-folded sheet for pressing said fan-folded sheet;

a second pressing member arranged to be integrally movable with said charger member for pressing said fan-folded sheet from the opposite surface of said image-forming surface when said charger is located at an image transferring operating position, at which an image formed on said photoconductive member is transferred to said fan-folded sheet;

said first pressing member comprising an arm member, including a plate part that is in contact with said fan-folded sheet, arranged to be rocked by means of an elastic member, said elastic member comprising a spring mounted on said plate part; and whereby said fan-folded sheet is forced to be separated from said photoconductive member when said charger member is retracted from said operating position.

8. The sheet separating mechanism according to claim 7, wherein said elastic member comprises a spring mounted on said plate part.

9. The sheet separating mechanism according to claim 7, wherein said stopping mechanism comprises a stopper part successively formed to said plate part and a contact part provided within said imaging device, said contact part being arranged to be contacted with said stopper part when said arm member is rocked by a predetermined amount.

10. The sheet separating mechanism according to claim 7, wherein said pressing member is located substantially at a position on said fan-folded sheet at which said second pressing member is contacted with said fan-folded sheet.

11. A sheet separating mechanism adapted to be positioned in an imaging device that includes a photoconductive member, a charger member and a fan-folded sheet upon which an image is to be formed, comprising;

a first pressing member arranged to be contacted with an image forming surface of said fan-folded sheet for pressing said fan-folded sheet; and a second pressing member arranged to be integrally movable with said charger member for pressing said fan-folded sheet from the opposite surface of said image forming surface when said charger is located at an image transferring operating position, at which an image formed on said photoconductive member is transferred to said fan-folded sheet;

said pressing member comprising an elastic sheet arranged to be contacted with said image forming surface of said fan-folded sheet;

whereby said fan-folded sheet is forced to be separated from said photoconductive member when a charger member is retracted from said operating position.

12. A sheet separating mechanism, adapted to be positioned in an imaging device that includes an photoconductive member, a charger member and a fan-folded sheet upon which an image is to be formed, comprising:

a first pressing member arranged to be contacted with an image-forming surface of said fan-folded sheet for pressing said fan-folded sheet;

a second pressing member arranged to be integrally movable with said charger member for pressing said fan-folded sheet from the opposite surface of said image-forming surface when said charger is located at an image transferring operating position at which an image formed on said photoconductive member is transferred to said fan-folded sheet;

said pressing member comprising a plate member arranged to be rocked and an elastic sheet member adhered to said plate member;

whereby said fan-folded sheet is forced to be separated from said photoconductive member when said charger member is retracted from said operating position.

* * * * *

UNITED STATES PATENT AND TRADEMARK OFFICE

CERTIFICATE OF CORRECTION

PATENT NO. : 5,155,539

DATED : October 13, 1992

INVENTOR(S) : H. Yamaguchi et al

BEST AVAILABLE COPY

It is certified that error appears in the above-indentified patent and that said Letters Patent is hereby corrected as shown below:

Cover page. 57/Abstract (line 1). change "In a" to ---A---.

Cover page. 57/Abstract (line 1). after "mechanism" insert ---is provided---.

Cover page. 57/Abstract (line 4). after "image" delete "having been".

Cover page. 57/Abstract (line 6). after "transferred by" delete "means of".

Cover page. 57/Abstract (line 6). after "member" insert ---,---.

Cover page. 57/Abstract (line 13). change "position: the" to ---position. The---.

Cover page. 57/Abstract (line 14). change "compromising to ---included---.

At column 7. line 27 (claim 1. line 7). change "in" to ---at---.

At column 7. line 35 (claim 1. line 15). change "imaging" to ---image---.

At column 7. line 60 (claim 4. line 4). change "an" to ---a---.

At column 10. line 9 (claim 12. line 2). change "an" second occurrence. to ---a---.

Signed and Sealed this

Fourteenth Day of November, 1995

Bruce Lehman

*Attest:*

BRUCE LEHMAN

*Attesting Officer*

*Commissioner of Patents and Trademarks*